United States Patent [19]

Bilger et al.

[11] Patent Number: 4,876,943

[45] Date of Patent: Oct. 31, 1989

[54] AUTOMATIC MACHINE GUN

[75] Inventors: Gerhard Bilger, Lauterbach; Helmut Mader, Schramberg, both of Fed. Rep. of Germany; Erich Matzagg, Oberndorf, Austria

[73] Assignee: Mauser-Werke Oberndorf GmbH, Oberndorf, Fed. Rep. of Germany

[21] Appl. No.: 70,568

[22] Filed: Jul. 7, 1987

[30] Foreign Application Priority Data

Jul. 12, 1986 [DE] Fed. Rep. of Germany ..... 3623565

[51] Int. Cl.[4] ..... F41D 11/02

[52] U.S. Cl. ..... 89/141

[58] Field of Search ..... 89/27.3, 140, 141, 142, 89/144

[56] References Cited

U.S. PATENT DOCUMENTS 3,306,167 2/1967 Ramseyer ..... 89/140

4,348,940 9/1982 Bremer et al. ..... 89/140

FOREIGN PATENT DOCUMENTS 684720 12/1939 Fed. Rep. of Germany ..... 89/27.3

74556 5/1933 France ..... 89/140

*Primary Examiner*—Stephen C. Bentley

*Attorney, Agent, or Firm*—McGlew & Tuttle

[57] ABSTRACT

To permit single firing in a machine gun by a mechanical method, a trip lever is moved by a control surface attached to the weapon housing during the weapon recoil after triggering a shot. This motion causes the trip lever to disengage a coupling on the crankshaft. Because of this, the trigger plate can return to its starting position by means of spring force, independently of the position of the cocking lever. The recoil breech can then be caught by the trigger in the weapon housing. If the cocking lever is moved back, it again couples because of the spring.

4 Claims, 4 Drawing Sheets

AUTOMATIC MACHINE GUN

BACKGROUND OF THE INVENTION

FIELD OF THE INVENTION

This invention concerns an automatic weapon, in particular an automatic machine gun with a firing mechanism for single shots and optionally for continuous firing.

In the ordinary gun mounts and machine armor, it is customary to trigger a single shot with electrical or electrohydraulic trigger mechanisms. In case of a power failure, it is then a problem to fire machine guns of the type mentioned intially with single shots. Ordinarily, such machine guns have a mechanical foot trigger because the triggering forces are normally so high that they cannot be overcome by hand, or only with great difficulty. The foot trigger and also alternatively the hand trigger has the disadvantage, however, that the foot or the hand cannot be taken away from the trigger in the extremely short time for discharging one shot. The result is that a firing burst has already left the gun barrel in a short time.

SUMMARY OF THE INVENTION

The invention provides an automatic weapon with a device that guarantees perfect operation for single shots and to some extent for continuous firing, by simple mechanical means.

It is crucial in this invention that the trigger plate connected to the trigger of the automatic weapon in accordance with the features of the invention can return to its starting position independently of the position of the cocking lever. This means that when triggering a shot by actuating the cockink lever, the return breech can be caught by the trigger in the weapon housing. This also solves the basic problem of the trigger immediately disconnecting when the weapon with its housing begins to recoil. Specifically, the weapon housing with the breech pushes back the trip lever, which disconnects at the same moment. At the moment of disconnection, the trigger plate is held back by the camshaft through a return spring, because of which the trigger immediately becomes free and the returning breech is caught. The solution therefore lies in a movable intermediate member, namely the fork acting on the coupling, which is switched on and off.

Accordingly, it is an object of the invention to provide a mechanism for permitting a single firing in a machine gun which has a weapon housing with a firing trigger and a housing control service on a movable housing part which moves during the weapon breech recoil, after triggering a shot, and which comprises the crank shaft which has engageable and disengageable crank shaft portions with the trigger plate being carried by one of the crank shaft portions and with spring means which bias the trigger plate on the crank shaft portion into a starting position with said coupling portions engaged and which includes a movable cocking lever which is engageable with the crank shaft to disengage the portions and to permit reengagement of the portions whereby the breech thereby catches the trigger.

A further object of the invention is to provide a mechanism for permitting a single firing in a machine gun which is simple in design, rugged in construction and ecomonical to manufacture.

GENERAL DESCRIPTION OF THE PREFERRED EMBODIMENT

Figure 1:
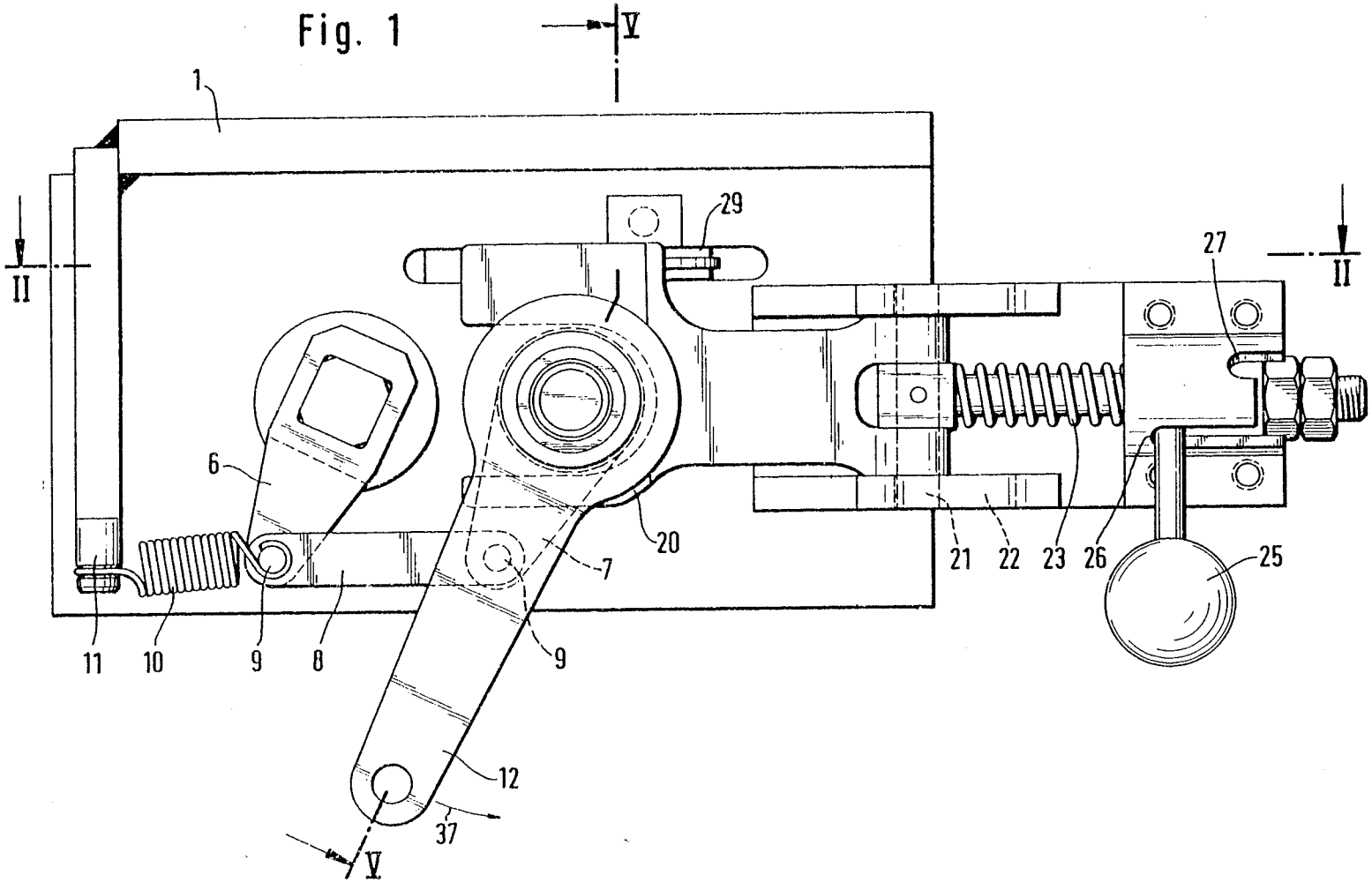
FIG. 1 is a plan view of the mechanical firing mechanism of a machine gun constructed in accordance with the invention.

Referring to the drawings in particular, the invention embodies therein a triggering mechanism for permitting a single firing in a machine gun by a mechanical method in which a trip lever 29 is moved by a control surface attached to the weapon housing during the weapon recoil after triggering a shot.

Two crankshafts 2 and 3 parallel to one another at a distance with integral cam disks 4 aligned parallel to one another are located in the weapon cradle of a machine gun, not shown in detail. A trigger plate 5 supported by the two crankshafts 2 and 3, is jointly fastened to the two cam disks in the manner of a parallel crank, so that the trigger plate 5 moves up and down in a straight line when the two crankshafts 2 and 3 rotate in parallel. The two crankshafts have respective crank arms 6 and 7 in the forward section that are connected to one another by a lever 8 as a parallel crank through pins 9 for rotary motion in the same direction. The crank arm 6 is connected to a return spring 10 that is connected to a part of the housing 11 of the weapon cradle 1. There is also a cocking lever 12 which is non-rotatable with respect to the crankshaft 3 but which is rotatable together with the crankshaft 3 in the forward area, that is connected to a return spring 13, which in turn is again connected to the housing part 11 of the weapon cradle. When one of the crankshafts 2 or 3 are rotated the other crankshaft is rotated simultaneously in the same direction.

The cocking lever 12 can move axially at the end of the crankshaft 3 against the action of a spring 14. The spring 14 rests at one end in a cup 15.

The cocking lever 12 has a coupling tooth construction 16 toward the cam disk 4 that is engaged with a coupling tooth construction 17 in a coupling plate 18 mounted on the crankshaft 3 for rotation therewith. The coupling tooth construction 16 and 17 can be designed either as spur gearing or as cams. The collar 19 on the cocking lever in the area of the coupling tooth construction 16 encloses a fork 20 which is mounted to rotate in an elongated hole in the weapon cradle 1 through a crosspin 21 and has a drive connection to a bolt 24 under the force of a spring 23. The bolt 24 can be moved axially with the help of an operating knob 25 and can be fastened in a forward position 26 or a rear position 27.

A trip lever 29 is also mounted in the housing part 28 of the weapon cradle 1 to pivot around a pin 30 that acts on one face of the fork 20 with a cam 31. The trip lever has a roller 33 at the forward arm 32 that can rotate around the pin 34 and extends out of the housing part 28 of the weapon cradle 1 and extends into the return path 35 of the weapon housing 36, which is movable forward and backward.

Figure 2:
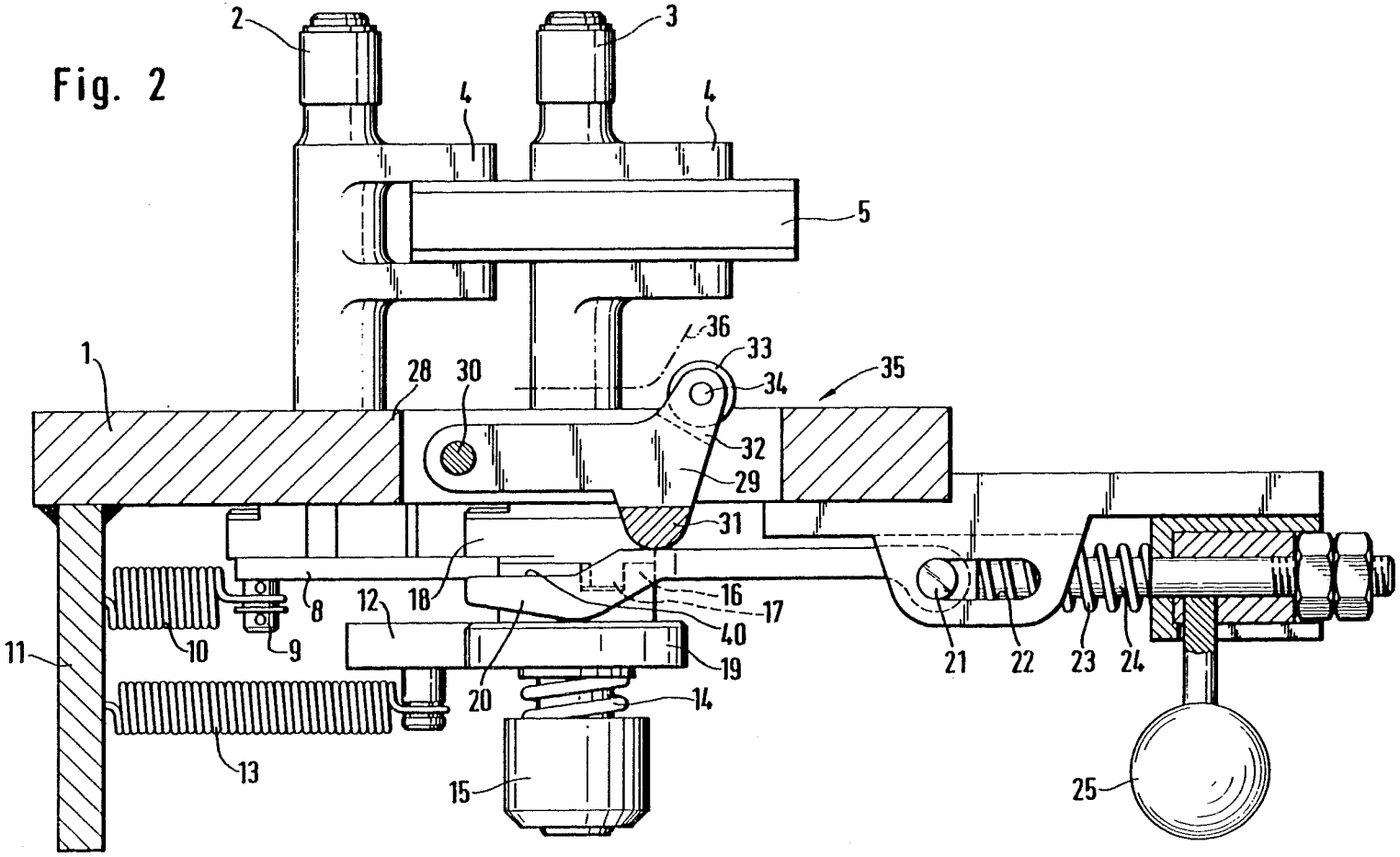
FIG. 2 is a section through the firing mechanism in the rest position taken along the line II—II in FIG. 1.

FIG. 2 shows the firing mechanism for single shots and for continuous firing in the rest position of the system, with the illustration showing the single-firing mechanism.

Figure 3:
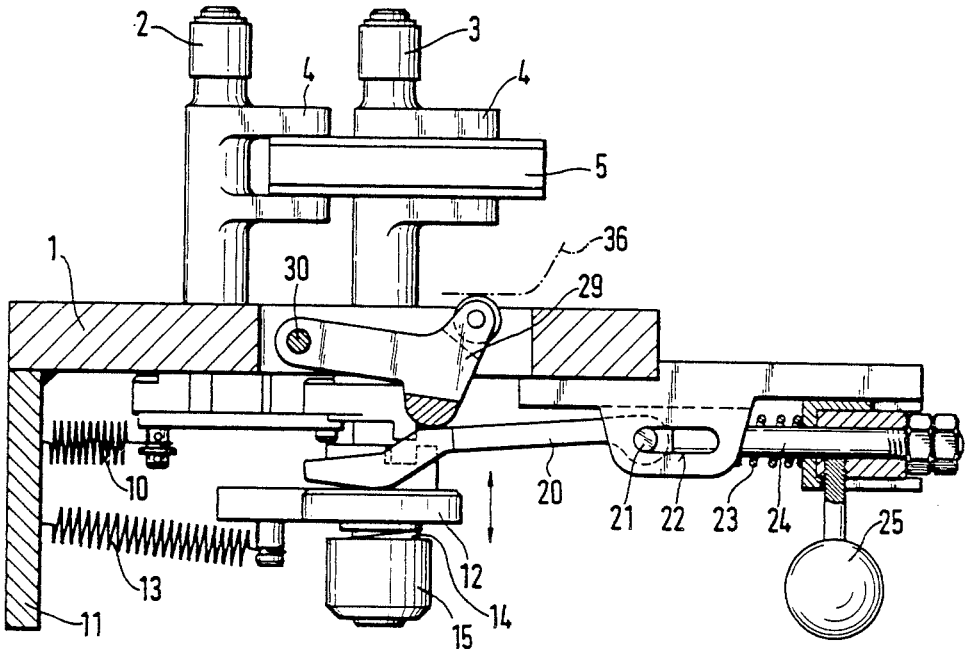
FIG. 3 is a sectional illustration of the firing mechanism of FIG. 2, but in a single-shot position.

FIG. 3 shows the single-shot position with the weapon already recoiled and illustrates the disconnected condition. By operating the cocking lever 12 in the direction of the arrow 37 (FIG. 1), the crankshaft 3 is rotated, which carries the crankshaft 2 with itself in the same direction because of the parallel crank 8. This moves the trigger plate 5 upwardly in a lifting direction, according to arrow 38 in FIG. 6.

The trigger roller 39 resting on the trigger plate 5 is lifted upward and thereby actuates the trigger lever (not shown) of the machine gun connected to it. Finally, this triggers a shot.

The trip lever 29 is pivoted forward on the pin 30 by a control surface attached to the weapon housing 36 with the weapon recoil that occurs immediately when the shot is triggered, so that its cam 31 presses against the fork 20, and this finally pushes the cocking lever 12 axially forward on the crankshaft 3 against the force of the spring 14. The coupling tooth construction 16 of the cocking lever 12 is disengaged from the coupling tooth construction 17 of the coupling plate 18 of the crankshaft 3 by the motion of the lever system described above. Because of the return force of the spring 10 and the parallel crank 8, both of the crankshafts 2 and 3 immediately pivot back into their starting positions, with the return spring 13 also pivoting the cocking lever 12 back into the starting position, which is now disengaged from the crankshaft 3. Because of this, the trigger plate 5 can than also return to its starting position by means of the spring force, independently of the position of the cocking lever 12. The recoiling breech can therefore be caught by the trigger in the weapon housing 36. If the cocking lever 12 is moved back, it immediately couples again because of the pressure of spring 14, so that the entire process described above can be repeated.

Figure 4:
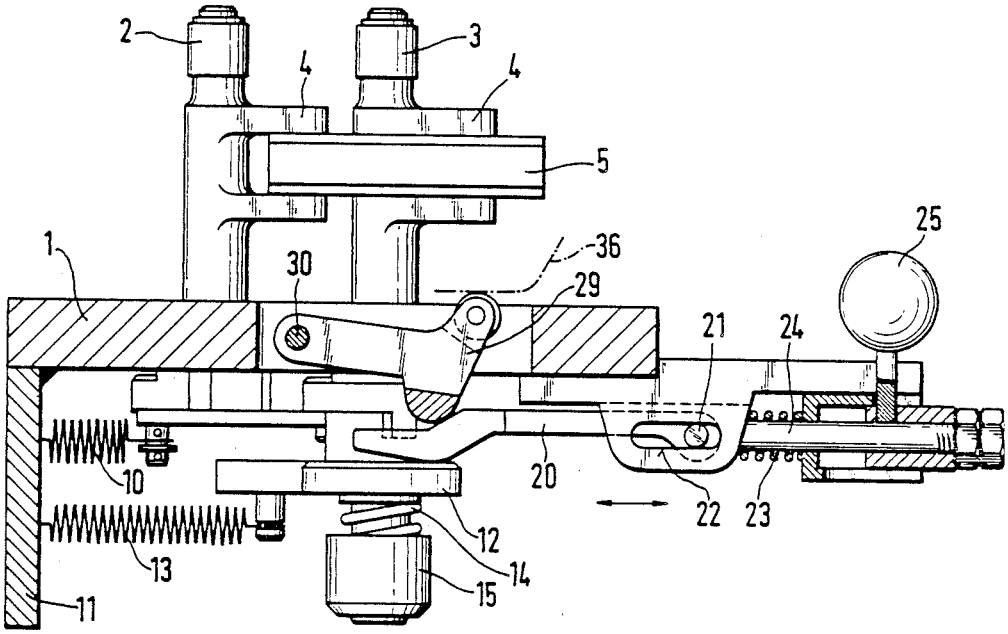
FIG. 4 is a sectional illustration of the firing mechanism of FIG. 2, but in continuous firing position.
Figure 5:
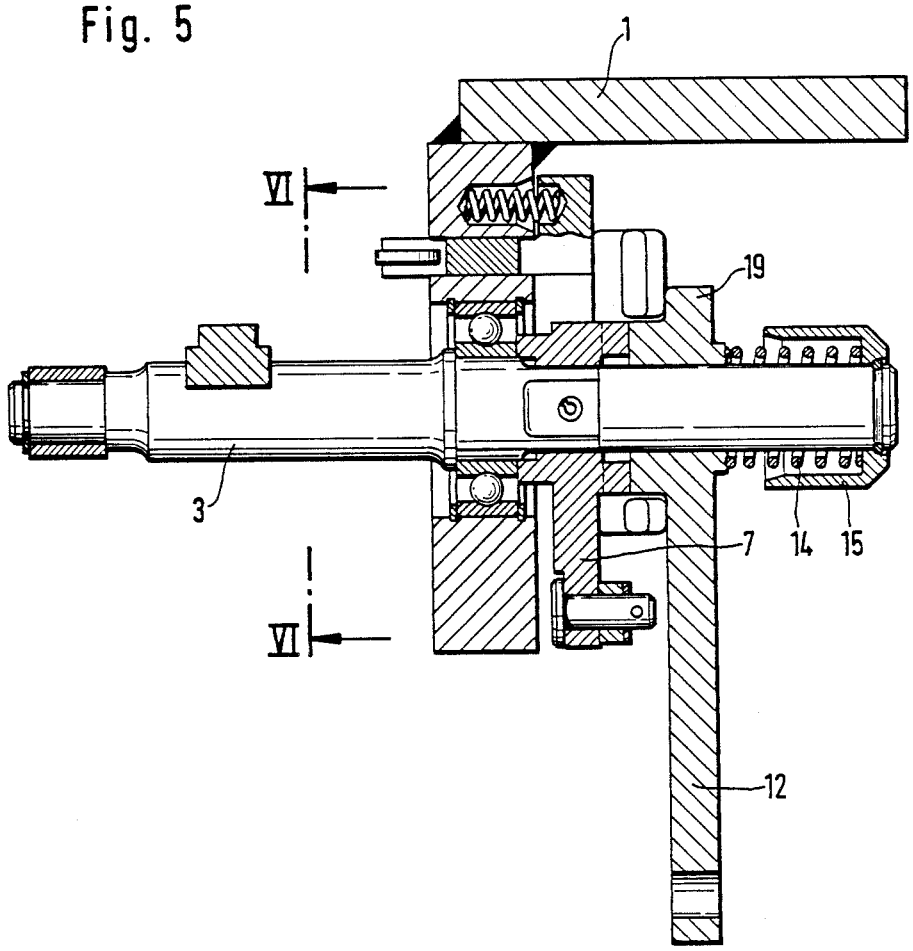
FIG. 5 is a section through a cocking lever along the line V—V in FIG. 1.

The continuous firing position of FIG. 4 is initiated by pushing the bolt 24 by means of the operating knob 25 from its forward position of FIGS. 2 and 3 into a rear position 27. This also moves the fork 20 attached to rotate over the pin 21 axially toward the rear in the direction of the bolt.

The offset part 40 of the fork 20 then lies beneath the cam 31 of the trip lever 29. The control surface of the weapon housing 36 can therefore no longer reach the trip lever 29, because of which the cocking lever 12 remains coupled continuously. Because of this, the recoiling breech can no longer be caught by the trigger in the weapon housing and remains continuously in the tripping position of the trigger.

Figure 6:
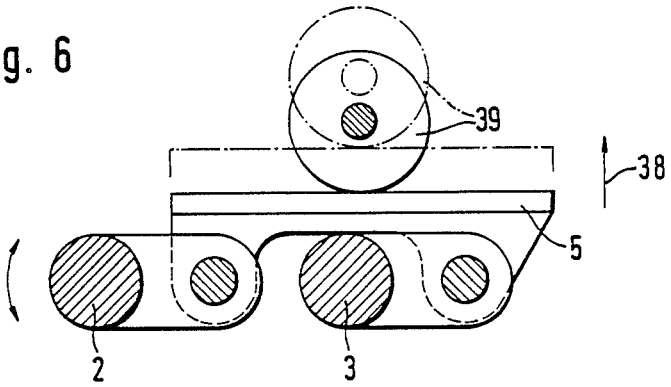
FIG. 6 is a section through the crankshaft along the line VI—VI in FIG. 5.

The invention provides an automatic machine gun weapon in which a trigger mechanism includes a housing which has a control surface which recoils when a shot is triggered. A trigger roller 39 as shown in FIG. 6 which rests on a trigger plate 5 lifts upwardly to actuate a trigger lever which triggers a shot. A trip lever 29 pivotally mounted on the housing is positioned in the path of movement of the housing control surfaces so as to be pivoted when a shot is triggered. The operating bolt 25 is slidable in the housing between a single shot position and a machine gun firing position. The fork 20 pivotally mounted in the housing on the bolt is axially shiftable with the bolt and has a control surface positioned so that it is engaged with the tripping lever 29. The shaft member 3 carrying the trigger plate 5 is rotatable to move the trigger plate upwardly and downwardly. It has an upper lever portion forming cocking lever 12 axially abutting the part 20 and rotatable to raise and lower the trigger plate. When the coupling means 17 and 18 are engaged and to prevent relative rotation of the shaft and cocking lever but to permit independent movement of the shaft carrying the trigger plate in a single shot firing position of the operating bolt. In the machine gun firing position the bolt is positioned so that coupling means is coupled so that the fork 20 is positioned to permit pivotable retraction of the trip lever 29 leaving the cocking lever 12 carried on the upper portion of the shaft coupled continuously. It also leaves the housing positioned so that it remains continuously in a tripping position of the trigger.

What is claimed is:

1. An automatic machine gun weapon housing a housing with a stationary and a movable part, a firing mechanism in said stationary housing part for tripping a trigger for single firing and optionally for continuously firing, comprising pivotal trigger means for tripping the trigger for single firing and continuous firing optionally, including a mechanically actuated cocking lever for cocking the trigger, and a trigger plate for tripping by said cocking lever and functionally connected to said trigger, said mechanism acting to return said trigger plate to its starting position independently of the position of said cocking lever, first and second separately rotatable but relatively non-rotatable crankshafts, a crank connected to each crankshaft, a parallel link interconnecting said crankshafts for parallel movement together at a spaced location apart, a cam disk on each crankshaft aligned parallel and holding said trigger plate for stroke motion in a straight line, a coupling engageable to prevent relative rotation of coupled parts located on said first crankshaft coupled with said coupling coupling in a gear connection with axial mobility for uncoupling with the movable part of said housing moving backward and forward, a fork rotatably mounted on said housing, a return spring action on said second crankshaft acting to move it in a return direction.

2. An automatic weapon pursuant to claim 1, including a fork, a trip lever that is mounted to pivot in said stationary housing, the movable housing part acting on said trip lever to move said trip lever against said fork, a coupling spring located on said crankshaft and in functional connection with a retaining spring, and a cocking lever mounted to be moved axially by said fork rotation and to rotate on said crankshaft against the force of said coupling spring.

3. An automatic weapon according to claim 1, wherein said fork has an end area mounted to rotate and to move longitudinally in said housing, an operating bolt connected to said fork, said bolt being securable in a forward position and in a spaced away rear position being movable in the direction of the longitudinal axis of said fork, said fork having a forward offset section, a trip lever resting on said forward offset section of said fork when said bolt is locked in the rear position.

4. An automatic machine gun weapon of the type in which a trigger mechanism includes a housing having a control surface which recoils after a shot is triggered comprising:

a crankshaft;

a trigger plate and a cocking lever mounted in axially spaced locations on the crankshaft;

disengageable coupling means engageable to couple the cocking lever and the crankshaft for rotation together from a starting to a triggering position thereby to move the trigger plate upwardly from a starting to a firing position and disengageable to enable rotational movement of the crankshaft independently of the cocking lever thereby to return the trigger plate to the starting position;

a trip lever pivotally mounted on the housing adjacent the cocking lever and aligned for engagement by the control surface during recoil to effect pivotal movement thereof;

an operating bolt mounted for sliding movement in the housing between a single shot and a machine gun firing position;

a fork having one end pivotally mounted in said housing on said bolt and having an offset on the opposite, divided end;

the divided end of the fork receiving the crankshaft at a location between the tripping lever and the cocking lever;

the fork being shiftable with said bolt between a single shot position in which the pivotable movement of the tripping lever by engagement with the recoiling control surface pivots the fork against the cocking lever thereby moving the cocking lever to disengage the coupling means and freeing the crankshaft for rotation independently of the cocking lever to return the trigger plate to a starting position, and a machine gun firing position in which the offset is interposed between the tripping lever and the cocking lever providing clearance for free pivotal movement of the tripping lever by the recoiling control surface with the coupling means remaining engaged operatively connecting the cocking lever continuously with the trigger plate continuously tripping the trigger.

* * * * *